US006802622B2

(12) United States Patent
Hsien

(10) Patent No.: US 6,802,622 B2
(45) Date of Patent: Oct. 12, 2004

(54) FLASHLIGHT WITH CONVEX LENS ASSEMBLY PROVIDING MULTIPLE FOCUSES

(76) Inventor: Chih-Ching Hsien, No. 367, Pei Yang Rd., Feng Yuan, Taichung (TW)

( * ) Notice: Subject to any disclaimer, the term of this patent is extended or adjusted under 35 U.S.C. 154(b) by 46 days.

(21) Appl. No.: 10/294,643

(22) Filed: Nov. 15, 2002

(65) Prior Publication Data

US 2004/0095757 A1 May 20, 2004

(51) Int. Cl.[7] ..... F21L 4/04

(52) U.S. Cl. ..... 362/187; 362/184; 362/205; 362/240

(58) Field of Search ..... 362/3, 11, 108, 362/119, 120, 157, 184, 185, 187, 188, 202, 205, 208, 227, 235, 236, 237, 240, 244, 257, 269, 277, 282, 311

(56) References Cited

U.S. PATENT DOCUMENTS 1,758,835 A * 5/1930 Hime ..... 362/205
2,339,356 A * 1/1944 Sachs ..... 362/187
4,851,974 A * 7/1989 Maglica ..... 362/187
6,367,949 B1 * 4/2002 Pederson ..... 362/240
6,474,837 B1 * 11/2002 Belliveau ..... 362/282
6,485,160 B1 * 11/2002 Sommers et al. ..... 362/184
6,626,556 B2 * 9/2003 Galli ..... 362/205

* cited by examiner

*Primary Examiner*—Thomas M. Sember
*Assistant Examiner*—Ismael Negron

(57) ABSTRACT

A flashlight having multiple focuses includes a tubular body for receiving a power supply device therein and a cap is connected to the tubular body. A bulb and reflection disk assembly is independently received in the cap and includes a plurality of bulbs connected to a reflection disk. The bulb and reflection disk assembly is electrically connected to the power supply device and a lens assembly including a plurality of convex lenses is fixedly connected to the cap and located in front of the bulbs. The convex lenses are rotated relative to the bulbs by rotating the cap so as to have different illumination features with different focuses.

1 Claim, 5 Drawing Sheets

FLASHLIGHT WITH CONVEX LENS ASSEMBLY PROVIDING MULTIPLE FOCUSES

FIELD OF THE INVENTION

The present invention relates to a flashlight with multiple focuses and includes multiple bulbs cooperated with multiple convex lenses.

BACKGROUND OF THE INVENTION

A conventional flashlight is shown in FIG. 1 generally includes a body 11 with an open end 14 and a threaded section 12 is defined in an outer periphery of the open end 14. Two batteries are received in the body 11 and a bulb assembly 10 is received in the open end 14 and electrically connected to the battery 15. A cap 16 with a rotatable collar 13 is threadedly connected to the threaded section 12. A switch is located at the outside of the body 11 so as to provide the electric power to the bulb assembly 10. Nevertheless, the flashbulb has only one focus which cannot be adjusted or changed. In practical use, different focuses for a flashlight is important because the different focuses provides various illumination features which meets the requirements of the users.

The present invention intends to provide a flashlight that is equipped with a plurality of bulbs which are located corresponding to a plurality of convex lenses so that the flashlight provides multiple-focuses illumination features.

SUMMARY OF THE INVENTION

In accordance with one aspect of the present invention, there is provided a flashlight having multiple focuses and the flashlight includes a tubular body having an open end so as to receive a power supply device via the open end, and a cap is connected to the open end. A bulb and reflection disk assembly is independently received in the cap and includes a plurality of bulbs connected to a reflection disk. The bulb and reflection disk assembly is electrically connected to the power supply device and a lens assembly is fixedly connected to the cap and located in front of the bulbs. The lens assembly comprises a plurality of convex lenses which are located corresponding to the bulbs.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
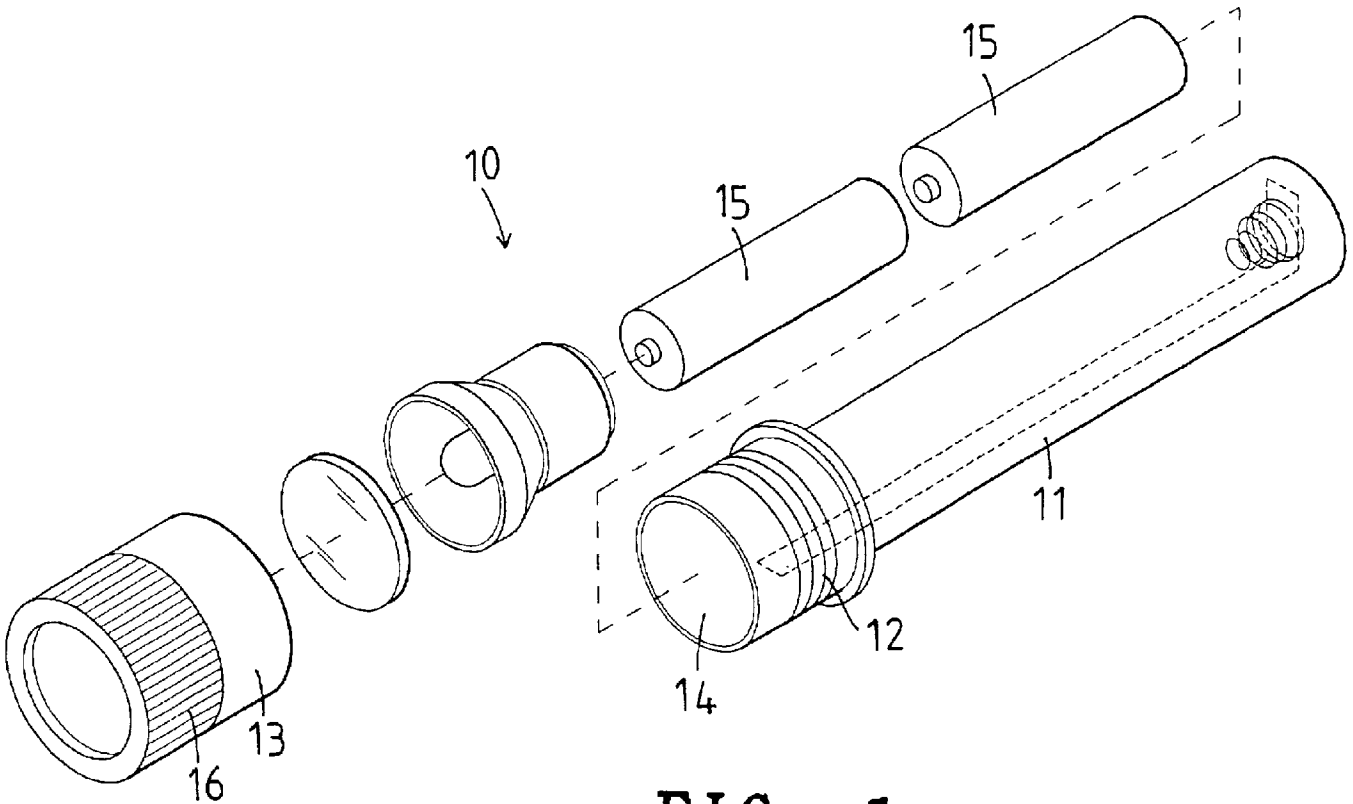
FIG. 1 PRIOR ART
FIG. 1 is an exploded view to show a conventional flashlight.
Figure 2:
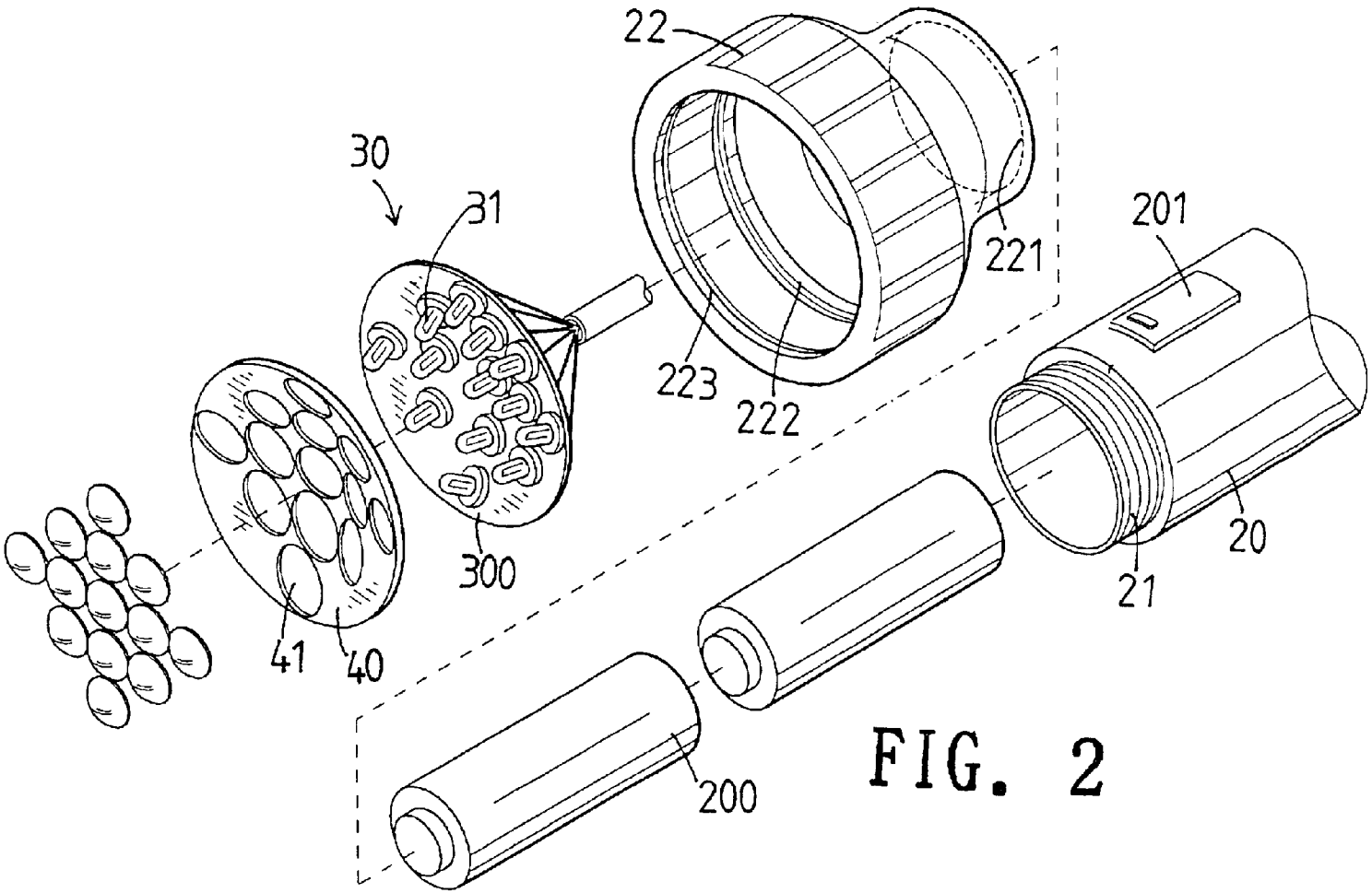
FIG. 2 is an exploded view to show the flashlight of the present invention.
Figure 3:
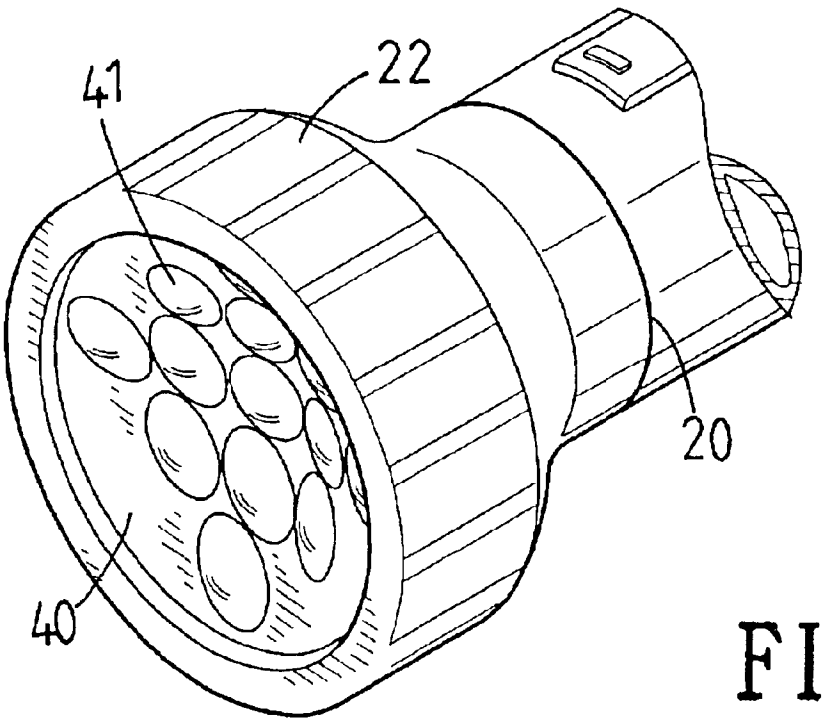
FIG. 3 is a perspective view to show the flashlight of the present invention.
Figure 4:
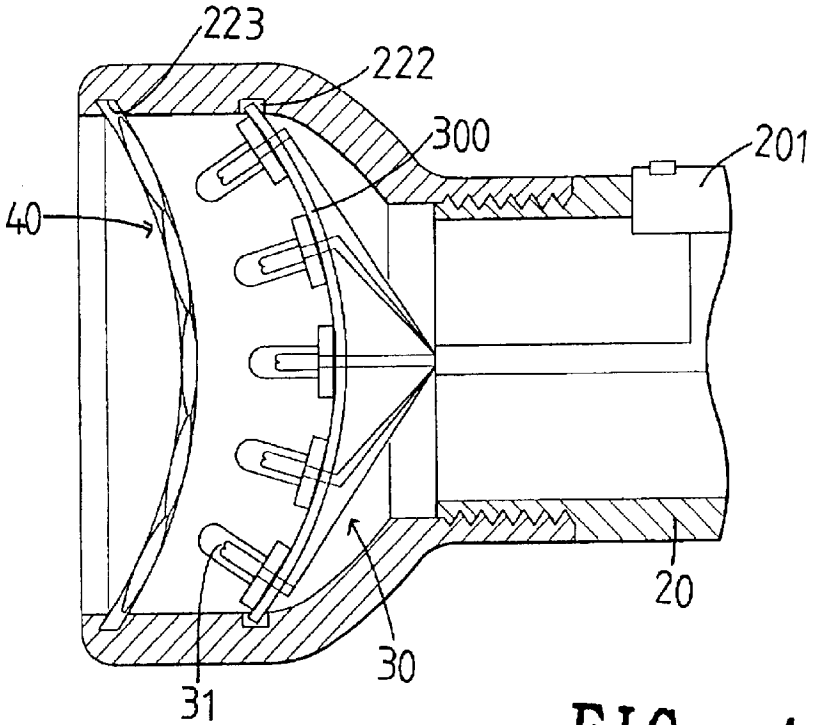
FIG. 4 is a cross sectional view to show the flashlight of the present invention.
Figure 5:
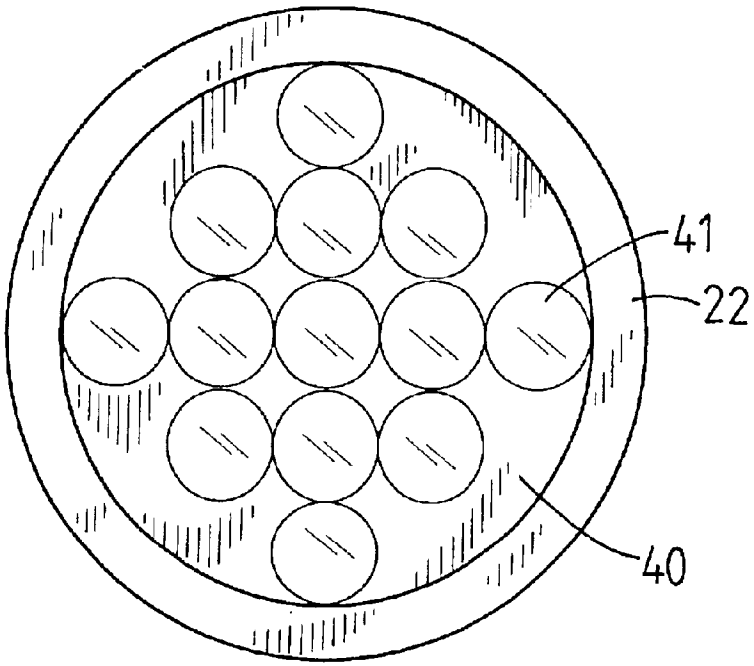
FIG. 5 is an end view to show the cap of the flashlight of the present invention.

Referring to FIGS. 2 to 5, the flashlight of the present invention comprises a tubular body 20 having an open end so that a power supply device 200 such as batteries is received in the tubular body 20 via the open end. A threaded section 21 is defined in an outer periphery of the open end so as to be connected to a cap 22 which uses a threaded inner periphery 221 to connect the threaded section 21. A switch 202 is connected to the tubular body 20.

A bulb and reflection disk assembly 30 is received in the cap 22 and electrically connected to the power supply device 200 and the switch 202. The bulb and reflection disk assembly 30 includes a plurality of bulbs 31 connected to a reflection disk 300. A lens assembly 40 is fixedly connected to an inside of the cap 22 and located in front of the bulbs 31. The lens assembly 40 comprises a plurality of convex lenses 41 which are located corresponding to the bulbs 31. The cap 22 has a first groove 222 and a second groove 223 respectively defined in the inside thereof, wherein the reflection disk 300 is freely engaged with the first groove 222 and the lens assembly 40 is secured engaged with the second groove 223.

The positions of the convex lens 41 are changed relative to the bulbs 31 by rotating the cap 22 so as to obtain different illuminating features with different focuses.

While we have shown and described the embodiment in accordance with the present invention, it should be clear to those skilled in the art that further embodiments may be made without departing from the scope of the present invention.

What is claimed is:

1. A flashlight having multiple focuses, comprising:

a tubular body having an open end so as to be adapted to receive a power supply device via the open end, a cap connected to the open end and a first groove and a second groove respectively defined in an inside of the cap, and a bulb and reflection disk assembly independently received in the cap and including a plurality of bulbs connected to a reflection disk, the bulb and reflection disk assembly electrically connected to the power supply device, the reflection disk freely engaged with the first groove, and a lens assembly securely engaged with the second grove of the inside of the cap and located in front of the bulbs, the lens assembly comprising a plurality of convex lenses which are located corresponding to the bulbs.

* * * * *